US005142893A

United States Patent [19]

Rozmus et al.

[11] Patent Number: 5,142,893

[45] Date of Patent: Sep. 1, 1992

[54] TUBE MILL

[75] Inventors: William Rozmus, Pittsburgh; Rudy M. Trbovich, Midland, both of Pa.

[73] Assignee: Italimpianti of America, Inc., Coraopolis, Pa.

[21] Appl. No.: 701,742

[22] Filed: May 17, 1991

[51] Int. Cl.[5] ..... B21D 19/04

[52] U.S. Cl. ..... 72/95; 72/100; 72/239

[58] Field of Search ..... 72/95, 96, 100, 238, 72/239

[56] References Cited

U.S. PATENT DOCUMENTS 3,845,646 11/1974 Bellmann et al. ..... 72/100
4,387,584 6/1983 Akita et al. ..... 72/100
4,449,386 5/1984 Akita et al. ..... 72/95
4,976,127 12/1990 Rohde et al. ..... 72/95

FOREIGN PATENT DOCUMENTS 3644780 4/1988 Fed. Rep. of Germany ..... 72/95
0157705 6/1989 Japan ..... 72/95

*Primary Examiner*—David Jones
*Attorney, Agent, or Firm*—Webb, Burden, Ziesenheim & Webb

[57] ABSTRACT

A seamless tube mill comprises two disk rolls mounted to be driven in rotation on substantially parallel axes which axes are perpendicular to guide the workpiece along the pass line which rolls may be rotated away from the pass line to enable removal and replacement thereof without disconnecting and realigning the input shafts thereto.

4 Claims, 4 Drawing Sheets

TUBE MILL

FIELD OF THE INVENTION

This invention relates to apparatus for forming seamless metal tubes and particularly to the arrangement for the positioning and changing of disk-type guide rolls in a piercing or elongating mill.

BACKGROUND OF THE INVENTION

In mills for piercing round billets for the manufacture of seamless steel tubing or the like, the billet is advanced along the pass line of the mill between two sizing rolls on axes inclined at small angles with the pass line of the mill. The roll surfaces are contoured so that the space between the rolls converges toward the delivery side of the mill to a minimum called the gorge and then diverges to form the outlet pass. The shafts of the rolls are mounted in bearings that can be moved toward and away from the pass line to accommodate the particular size of billet being processed. Between the guide rolls in the pass outlet, a projectile-shaped piercing plug is held in position on the end of a water cooled mandrel support bar. The point of the piercing plug extends just beyond the gorge toward the feed side of the rolls.

A solid round billet is heated and transferred to a trough on the feed side of the mill. The trough positions the billet at the pass line. The heated billet is pushed forward into the space between the rolls. Because of the angle of the sizing rolls axes relative to the pass line, the billet is rotated and axially advanced through the mill over a piercing plug.

Much the same equipment is used to elongate a tube in an elongating mill. The projectile-shaped piercing plug is replaced with a water cooled mandrel support bar. The sizing rolls are shaped somewhat differently. The heated tube is transferred to the trough on the feed side of the mill and advanced between the sizing rolls and over the working bar.

In one type of seamless tube mill known as a disk-type mill, the billet is held on the correct pass line as it moves through the mill by two disk-type guide rolls having concave toroidal edges that embrace portions of the surface of the billet on opposite sides of the billet.

Since the diameter of the concave toroidal surfaces on the rim of the disk-type guide rolls (hereafter "disk rolls") must be substantially the same as the billet or tube being guided through the mill, the disk rolls must be easily removed and replaced when the tube diameter is changed or when the disk rolls become worn. In the past, the removal and replacement has been very time consuming. The drives to the axles of the disk rolls were disconnected to permit movement of the rolls to a position where they could be removed and replaced. The disconnection, reconnection and alignment of the drives was time-consuming work.

Several schemes have been proposed to avoid disconnecting the drives. In one, the disk rolls are mounted to rotate in a vertical plane while guiding the billet or seamless tube. The disk is held by a crane hook and pushed off the arbor of its axle shaft and lifted up out of the mill housing. In another arrangement, the disks are horizontal. At the time of exchanging a disk roll, the disk roll is released into an arm and the arm pivots out of the mill housing. These designs have drawbacks even though it is not necessary to disconnect the power train to change disk rolls.

SUMMARY OF THE INVENTION

It is an object according to this invention to mount disk rolls in a seamless tube mill for easy removal and replacement without disconnecting the power trains that drive the disk rolls.

Briefly according to this invention, a seamless tube mill for piercing billets or elongating seamless tubes of the type comprising a mill stand through which the tube passes axially along a pass line comprises at least two sizing rolls journaled within the mill stand and two removable disk rolls. The disk rolls are mounted to be driven in rotation on substantially parallel axes which axes are perpendicular to the pass line. The disk rolls having outer rims defined by a concave toroidal surface matching a substantial portion of the surface of the billet or tube processed by the mill. When properly positioned, the disk rolls hold the billet or tube at the correct position along the pass line. Rotatable disk drive shaft housings on opposite sides of the pass line are mounted for rotation on axes substantially parallel to the axes of rotation of the disk rolls. Driven shafts are journaled in the disk drive shaft housings on which the disk rolls are respectively mounted. The power trains for driving the driven shafts comprise collapsible input shafts, motors fixed relative to the mill stand for driving the collapsible input shafts through fixed pivot universal joints and right angle drive means rotatably mounted to the rotatable disk drive shaft housings for transferring torque from the collapsible input shafts to the driven shafts. The collapsible shafts may comprise intermeshing shafts, that is shafts having two parts, one part having external splines and the other having internal splines. The right angle drives may comprise bevel gear drives. Universal joints are provided between the collapsible shafts and the right angle drives. The elements described are arranged so that the rotatable disk drive shaft housings may be rotated away from the pass line to enable removal and replacement of the disk rolls without disconnecting and realigning the input shafts.

BRIEF DESCRIPTION OF THE DRAWINGS

Further features and other objects and advantages will become apparent from the following detailed description made with reference to the drawings in which.

DESCRIPTION OF THE PREFERRED EMBODIMENT

Figure 1:
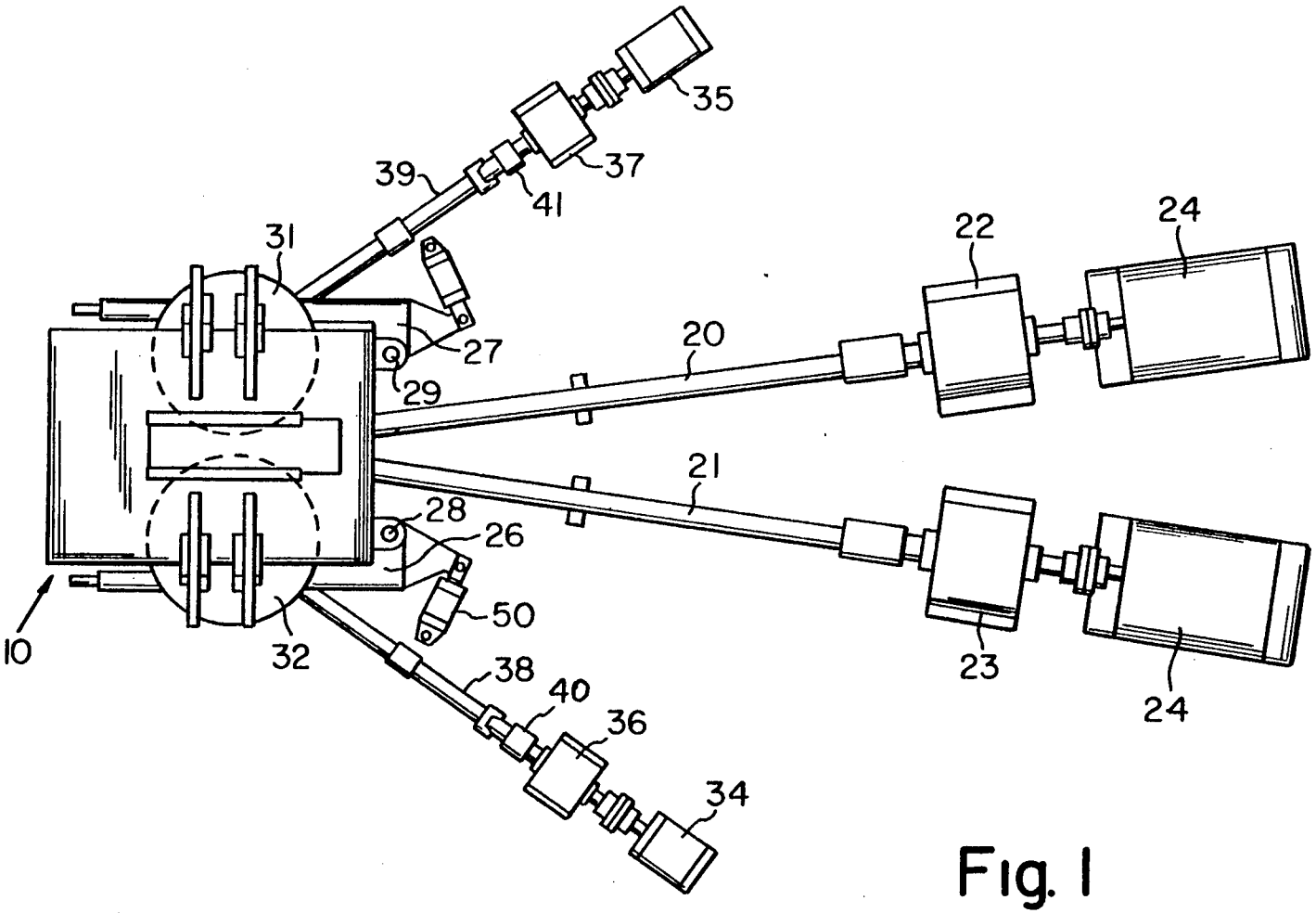
FIG. 1 is a plan view of a seamless tube mill according to this invention.
Figure 2:
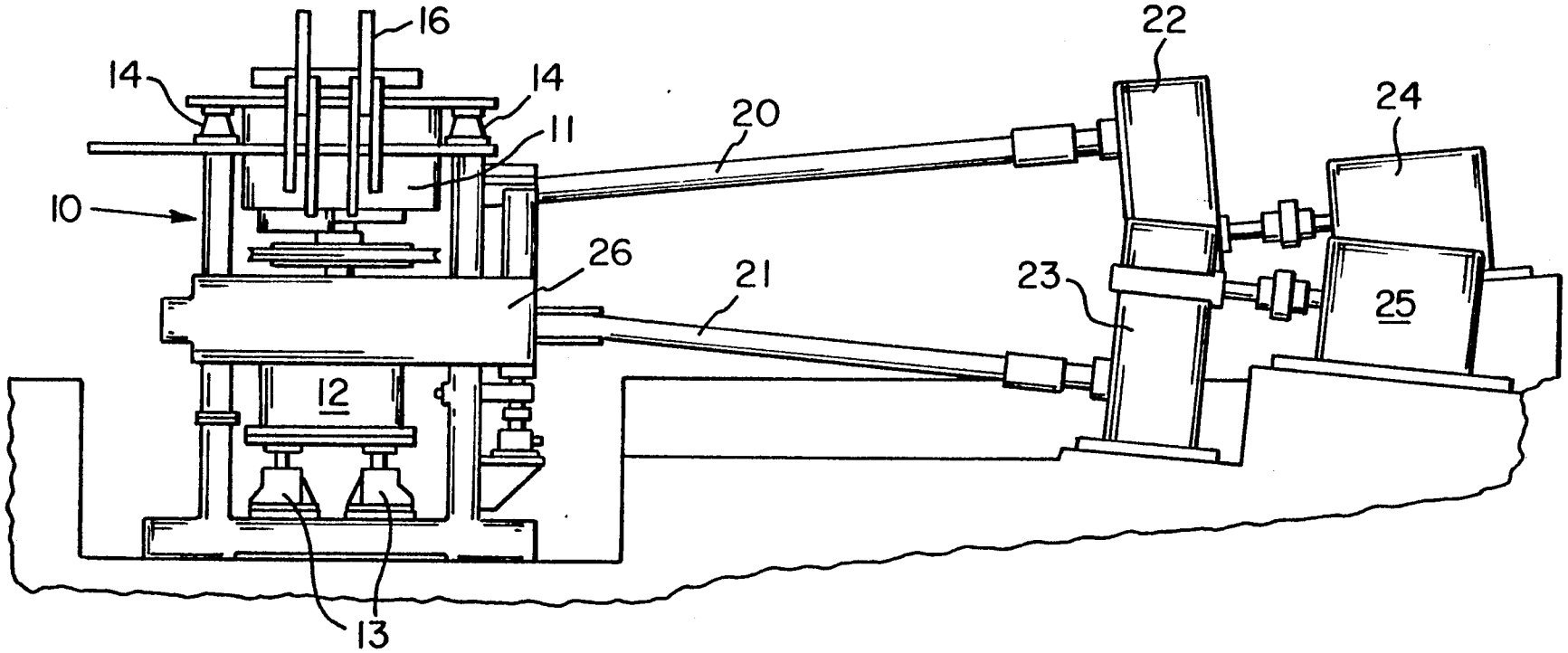
FIG. 2 is an elevation view of the mill shown in FIG. 1.

Referring to the drawings, the mill comprises a stand 10 within which upper 11 and lower 12 sizing roll cradles are positioned. The lower sizing roll cradle is mounted on jacks 13 that move the lower roll cradle toward and away from the pass line. The upper sizing roll cradle is also mounted on jacks 14 and is provided with a clamping mechanism 16 to fix the upper sizing roll cradle relative to the stand. The sizing rolls 17 and 18 are mounted for rotation within the upper and lower cradles. The sizing rolls rotate upon axes that are at a slight angle to the pass line. The sizing rolls are driven through drive shafts 20, 21, through gear boxes 22, 23 by motors 24, 25.

Figure 6:
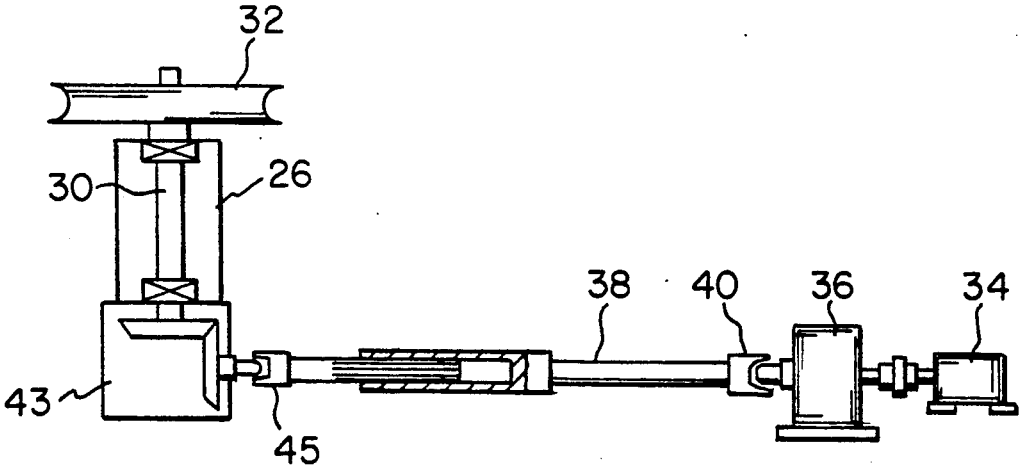
FIG. 6 is an elevation view corresponding to FIG. 5.

Disk drive shaft housings 26 and 27 are pivotally mounted to the mill stand at 28 and 29 respectively. The disk drive shaft housings rotate toward and away from the pass line. Pivotally mounted in the disk drive shaft housing on axes perpendicular to the pass line are driven shafts 30. (See FIG. 6) As indicated in the drawings, the shafts are vertical. Disk-type rolls 31, 32 are mounted on the driven shafts to rotate in a horizontal plane as shown in the drawings. A right angle drive is mounted to each pivot frame 26 and 27 to transfer power to the driven shafts. The right angle drives 43 may be bevel gear drives or the like. Power is supplied to the disk rollers by motors 34, 35, gear boxes 36, 37, and drive shafts 38, 39 through the right angle drives. The motors are connected to the drive shafts through universal couplings 40, 41. The drive shafts are connected to the right angle drives through universal couplings 45. The drive shafts are collapsible, that is, they comprise two interfitting parts that move axially relative to each other but are interfitting such that they must rotate together. For example, the one part of the collapsible shaft may have external splines and the other part internal mating splines.

Figure 3:
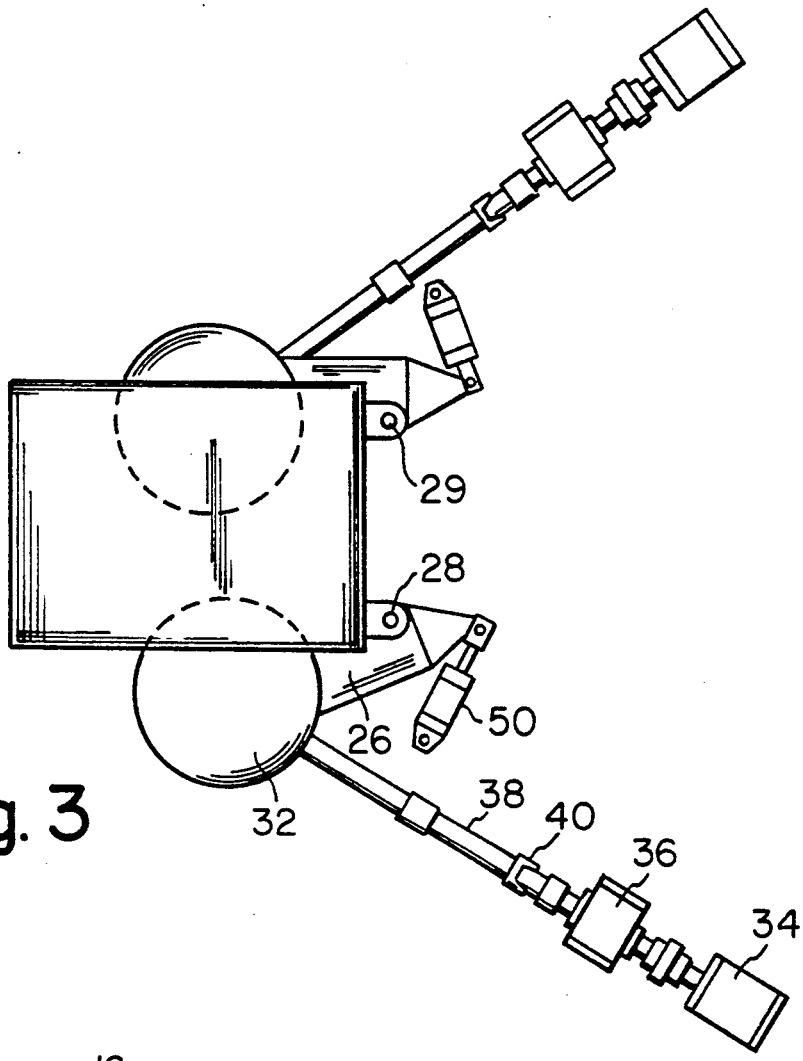
FIG. 3 is a partial plan view of the mill shown in FIG. 1 with one of the disk rolls rotated into the exchange position.
Figure 4:
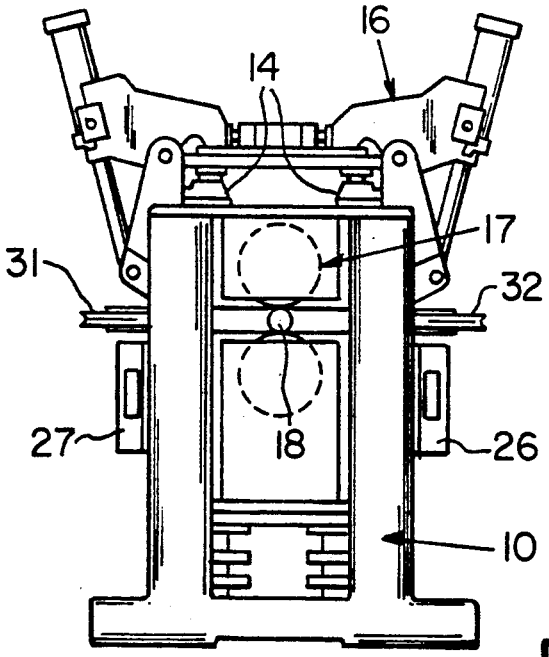
FIG. 4 is an end elevation view of the mill shown in FIG. 1.
Figure 5:
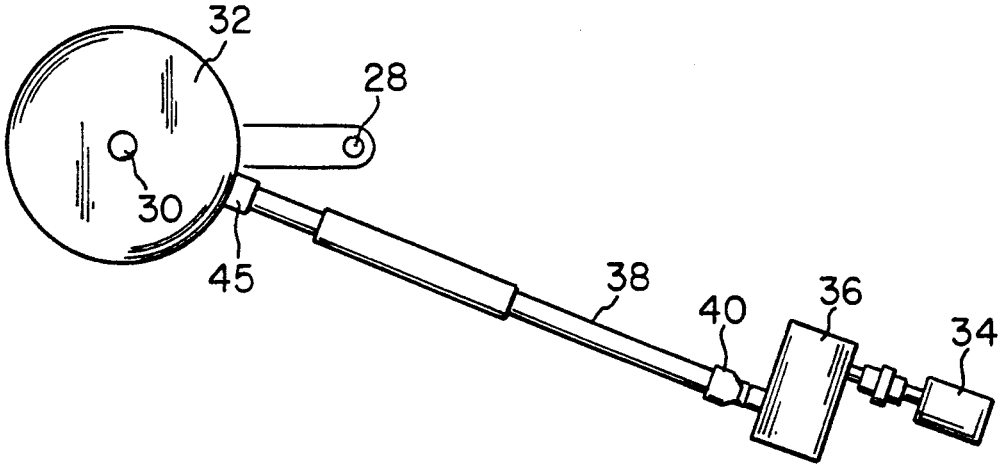
FIG. 5 is a plan view of the details of the collapsible drive.

Referring now to FIG. 3, at the time of changing disk roll 32, the pivot frame 26 is rotated away from the pass line without disconnecting the drive shaft 38. During this rotation of, for example, about 20 degrees, the drive shaft will shorten and the angle between the axis of the drive shaft and the axis of the motor 34 will change, this change being permitted by the universal coupling 40. Also, during rotation, the angle between the axis of the drive shafts 38 and the pivot frame 26 will change, this change being permitted by the universal coupling between it and the right angle drive. A hydraulic cylinder 50 may be used to cause rotation of pivot frame 26 about its pivot. In this position, the disk roll 32 can be removed from the arbor of the shaft 30 for exchange or replacement. After exchange of rolls, the pivot frame 26 is rotated back so that the edge of the disk roll will be in the correct position relative to the pass line. Since the drive shaft was not disconnected, it is not necessary to reconnect the drive shaft and to align machine elements. The disk rolls are immediately ready for use when rotated back to the correct position relative to the pass line.

Having thus defined our invention in the detail and particularity required by the Patent Laws, what is desired protected by Letters Patent is set forth in the following claims.

We claim:

1. In a seamless tube mill of the type comprising a mill stand through which the workpiece passes axially along a pass line, at least two sizing rolls journaled within the mill stand, two disk rolls mounted to be driven in rotation on substantially parallel axes which axes are perpendicular to the pass line, said disk rolls having outer rims shaped and positionable to guide the workpiece along the pass line, rotatable pivot frames on opposite sides of the pass line mounted for rotation on an axis substantially parallel to the axes of the disk rolls, driven shafts journaled in the pivot frames on which the disk rolls are respectively mounted, collapsible input shafts, motors fixed relative to the mill stand for driving the collapsible input shafts through a fixed pivot universal joint, right angle drive means mounted to the rotatable pivot frames for transferring torque from the collapsible input shafts to the driven shafts through universal joints, whereby the rotatable pivot frames may be rotated away from the pass line to enable removal and replacement of the disk rolls without disconnecting and realigning the input shafts.

2. The seamless tube mill according to claim 1 wherein the pivot frames may be rotated through an angle of about 20 degrees.

3. In a seamless tube mill of the type comprising a mill stand through which the workpiece passes axially along a pass line, at least two sizing rolls journaled within the mill stand, two disk rolls mounted to be driven in rotation on substantially parallel axes which axes are perpendicular to the pass line, said disk rolls having outer rims shaped and positionable to guide the workpiece along the pass line, rotatable pivot frames on opposite sides of the pass line mounted for rotation on an axis substantially parallel to the axes of the disk rolls, driven shafts journaled in the pivot frames on which the disk rolls are respectively mounted, collapsible input shafts, motors fixed relative to the mill stand for driving the collapsible input shafts through a fixed pivot universal joint, right angle drive means mounted to the rotatable pivot frames for transferring torque from the collapsible input shafts to the driven shafts through universal joints, whereby the rotatable pivot frames may be rotated away from the pass line to enable removal and replacement of the disk rolls without disconnecting and realigning the input shafts, and wherein the collapsible input shafts comprise mating internal and external spline shafts.

4. In a seamless tube mill of the type comprising a mill stand through which the workpiece passes axially along a pass line, at least two sizing rolls journaled within the mill stand, two disk rolls mounted to be driven in rotation on substantially parallel axes which axes are perpendicular to the pass line, said disk rolls having outer rims shaped and positionable to guide the workpiece along the pass line, rotatable pivot frames on opposite sides of the pass line mounted for rotation on an axis substantially parallel to the axes of the disk rolls, driven shafts journaled in the pivot frames on which the disk rolls are respectively mounted, collapsible input shafts, motors fixed relative to the mill stand for driving the collapsible input shafts through a fixed pivot universal joint, right angle drive means mounted to the rotatable pivot frames for transferring torque from the collapsible input shafts to the driven shafts through universal joints, whereby the rotatable pivot frames may be rotated away from the pass line to enable removal and replacement of the disk rolls without disconnecting and realigning the input shafts, and wherein the right angle drive is a bevel gear drive.

* * * * *